United States Patent [19]

Morris

[11] 4,436,244

[45] Mar. 13, 1984

[54] CARTON BLANK WITH INTEGRAL HANDLE

[76] Inventor: Charles K. Morris, 529 Smiths Rd., Templestowe, Victoria, 3081, Australia

[21] Appl. No.: 394,941

[22] Filed: Jul. 2, 1982

Related U.S. Application Data

[63] Continuation-in-part of Ser. No. 232,046, Jan. 23, 1981, abandoned.

[51] Int. Cl.[3] ..... B65D 5/46

[52] U.S. Cl. ..... 229/52 B; 229/37 R; 229/DIG. 6; 229/DIG. 9

[58] Field of Search ..... 229/52 B, 37 R, 54 R, 229/52 A, DIG. 6, DIG. 9; 150/12

[56] References Cited

U.S. PATENT DOCUMENTS

| | | | |
|---|---|---|---|
| 2,102,009 | 12/1937 | Kondolf | 229/52 B X |
| 2,196,185 | 4/1940 | Belcher | 229/54 R |
| 2,210,937 | 8/1940 | Geimer | 229/54 R |
| 2,367,717 | 1/1945 | Davidson | 229/DIG. 9 |
| 2,656,093 | 10/1953 | Smith | 229/54 R |
| 2,868,433 | 1/1959 | Anderson, Jr. | 229/52 B |
| 2,903,180 | 9/1959 | Holmes | 229/51 |
| 2,986,324 | 5/1961 | Anderson, Jr. | 229/52 B |
| 3,197,116 | 7/1965 | Zastrow | 229/52 B |
| 4,134,534 | 1/1979 | Scott et al. | 229/52 B |
| 4,378,905 | 4/1983 | Roccaforte | 229/52 B |

FOREIGN PATENT DOCUMENTS

| | | | |
|---|---|---|---|
| 1557784 | 12/1979 | United Kingdom | 229/54 R |

*Primary Examiner*—William Price
*Assistant Examiner*—Gary E. Elkins
*Attorney, Agent, or Firm*—Ladas & Parry

[57] ABSTRACT

A carton blank for forming a carton of square or rectangular cross section therefrom and adapted to be folded and joined to form a carton which is provided at one end with two pairs of opposed integral flaps, the first pairs of flaps being adapted to overlap and close off the carton end when folded thereover, the second opposed pairs of flaps each reducing in width from its connection with the carton end to form narrow extended portions, whereby the narrow extended portions may be joined when the second opposed pair of flaps is folded flat over the carton end to form a composite handle member, the composite handle member having a carry handle portion opposite ends of which join the broader sections of the second opposed pair of flaps, one flap of the first pair of opposed integral flaps including an integral strip with score lines, slits, perforations, or combinations thereof for facilitating severing of the strip therefrom, the one flap being dimensioned so that the strip underlies the carry handle portion when the first and second pairs of opposed flaps are folded down over the carton end. Also a multi-carton blank formed from a single sheet of material may be provided having at least two carton blanks as above described.

6 Claims, 14 Drawing Figures

CARTON BLANK WITH INTEGRAL HANDLE

This application is a continuation-in-part of serial number 232,046 filed Jan. 23, 1981 now abandoned.

This invention relates to a carton and blank design which incorporates provision for a handle and relates particularly but not exclusively to carton blank/handle constructions which are suitable for use with relatively heavy contents such as packaged wine and to cartons constructed from same.

The present invention provides a carton blank for forming a carton of square or rectangular cross section therefrom, wherein said carton blank is adapted to be folded and joined to form a carton which is provided at one end with two pairs of opposed integral flaps, the first of said pairs of flaps being adapted to overlap and close off said carton end when folded thereover, the second of said opposed pairs of flaps each reducing in width from its connection with the carton end to form narrow extended portions, whereby said narrow extended portions may be joined when said second opposed pair of flaps is folded flat over the carton end to form a composite handle member which lies generally flat over the carton end, covering and generally following the direction of a line joining the sides of the carton end to which said second opposed pair of flaps are attached and bisecting said carton end, said composite handle member having a carry handle portion opposite ends of which join the broader sections of said second opposed pair of flaps, said carry handle portion having a width substantially less than the edges of the carton end to which said second opposed pair of flaps are attached.

A multi-carton blank having at least two carton blanks as mentioned above is also provided by the invention. The multi-carton blank is formed from a single sheet of material and has a joinder area extending longitudinally of the sheet and in which the first and second pairs of flaps of each blank are located. The flaps of one blank are staggered relative to the flaps of the other blank so that portions of the flaps of one blank are contiguous with portions of the flaps of the other blank. In this way the area of wasted material resulting from manufacture may be minimized.

Preferably the narrow extended portion of each of said second opposed pair of flaps is elongate, and is shaped in such a way that it may be received in a cut out portion provided in corresponding first pairs of flaps forming part of the separate or second carton blank. The first pairs of flaps of said first carton blank are also most suitably provided with extended or nose portions which are adapted to overlie the cut out portions when the first pair of flaps is folded to close off one end of the carton.

Preferably the second opposed pair of flaps are joined together using adhesive tape, a wire staple, a metal or plastic clip or a pre-glued strip which may be separated from one of the flaps of said first pair of flaps.

Preferred embodiments of the invention will now be described with reference to the accompanying drawings wherein.

Figure 4:
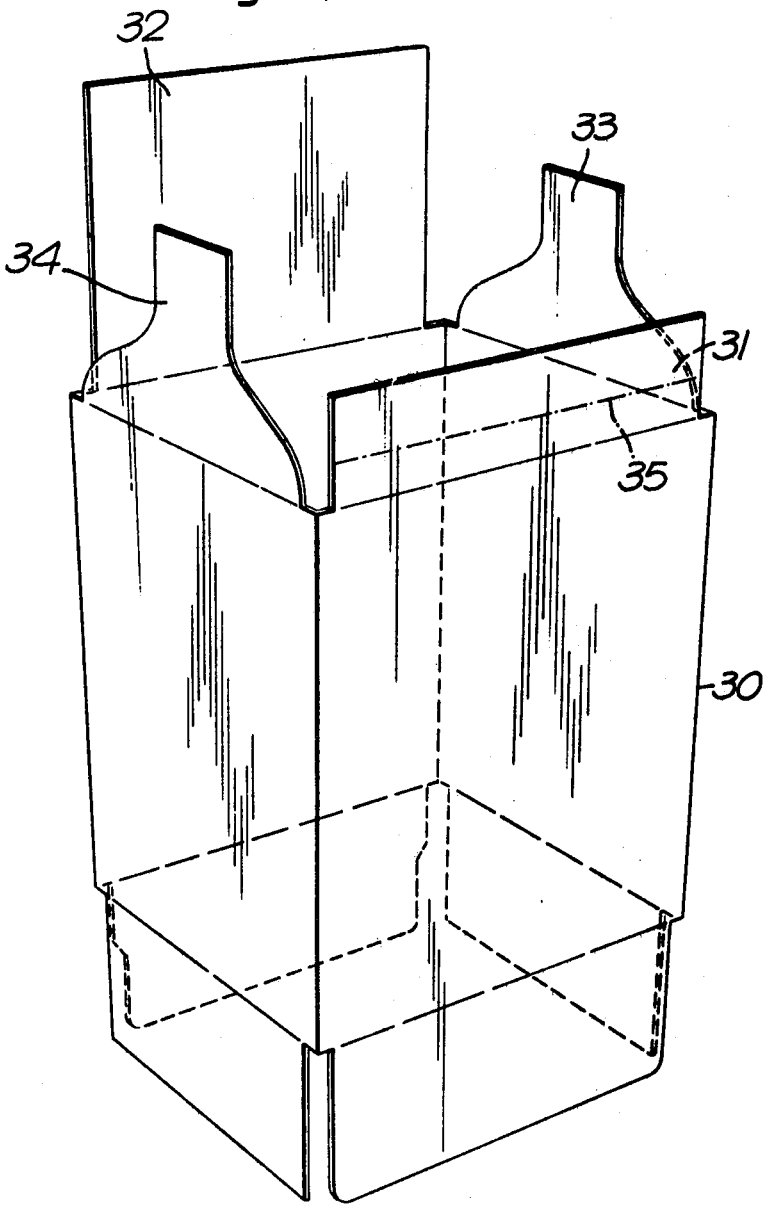
Figure 5:
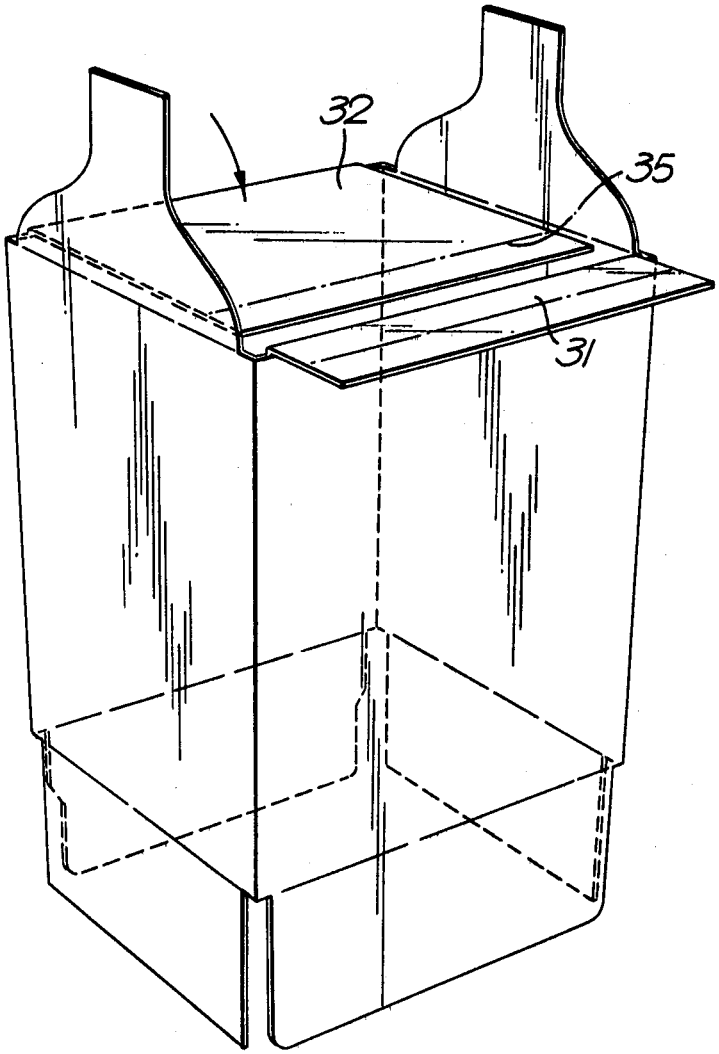
Figure 6:
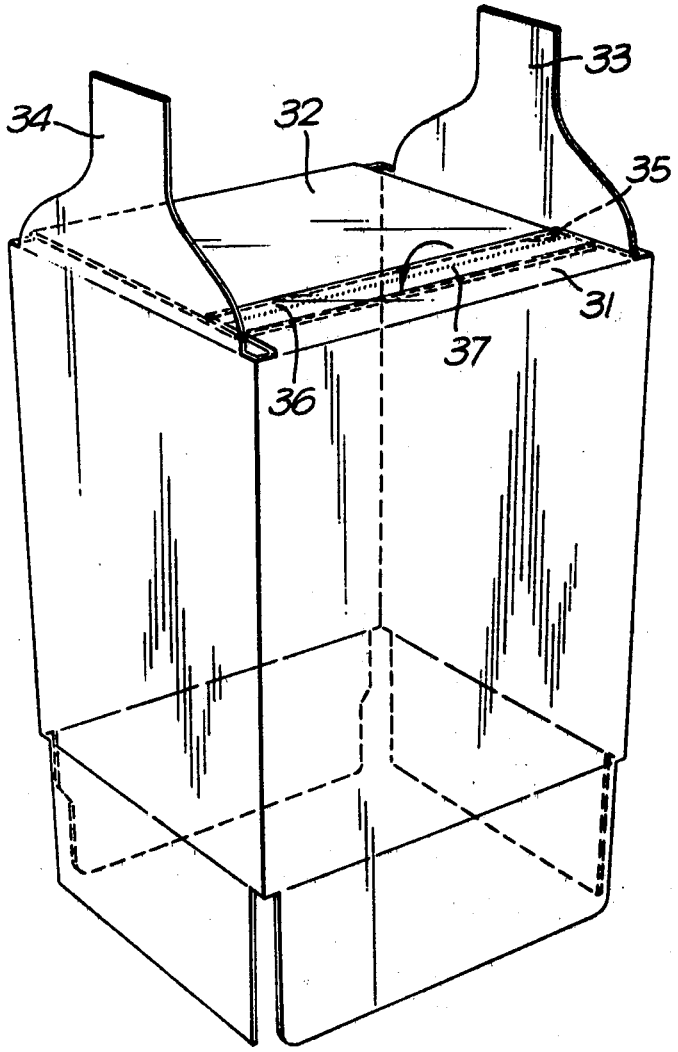
Figure 7:
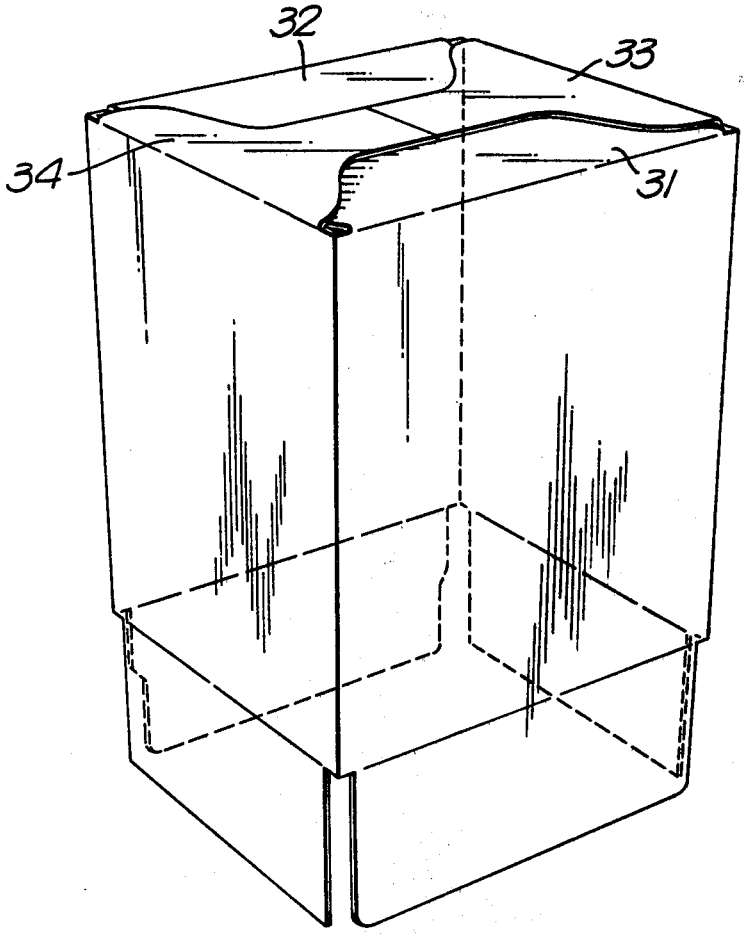
Figure 8:
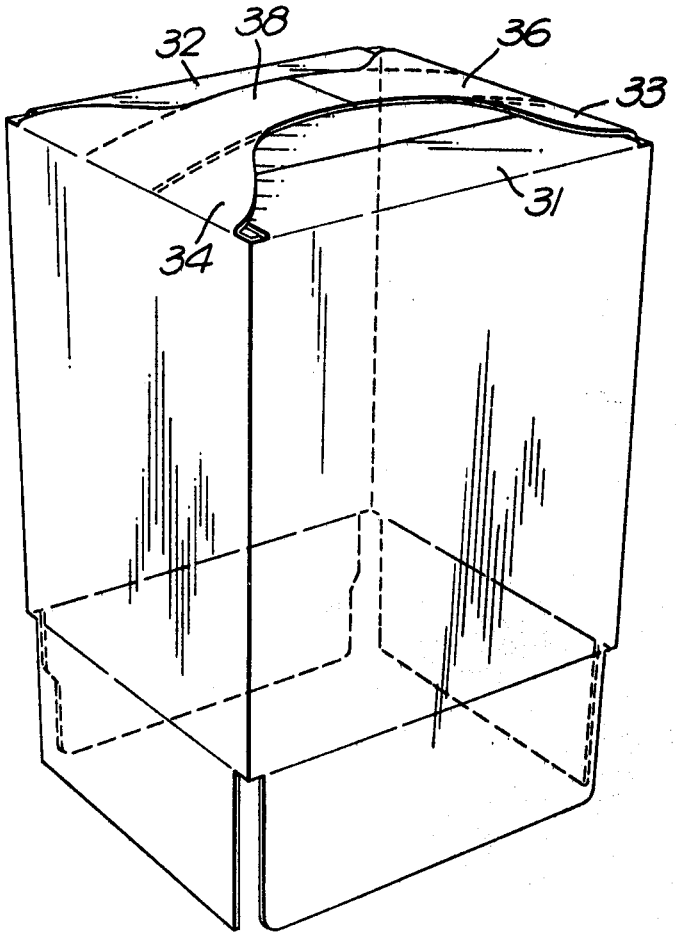

FIGS. *3a, 3b* and *3c* illustrate alternative methods of joining flaps to form a carry handle;

FIG. 4 is a perspective view of an alternative form of partially erected carton constructed in accordance with the invention.

FIGS. 5 to 8 illustrate the steps taken for folding the flaps of the upper end of the carton of FIG. 4 to form a closed end with a carry handle.

Figure 9:
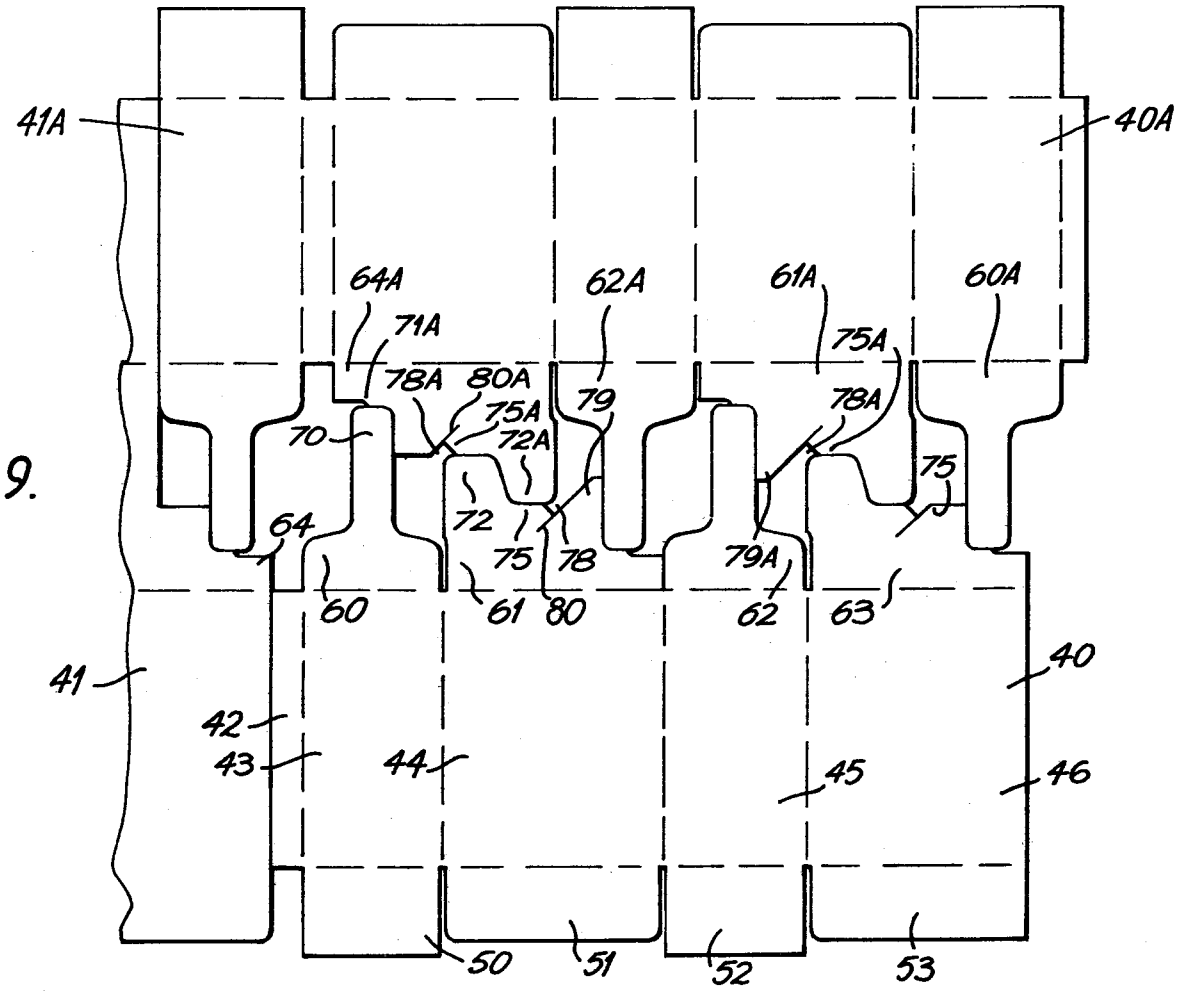

FIG. 9 illustrates a plan view of a series of cartons as they would be cut out from a planer sheet.

Figure 1:
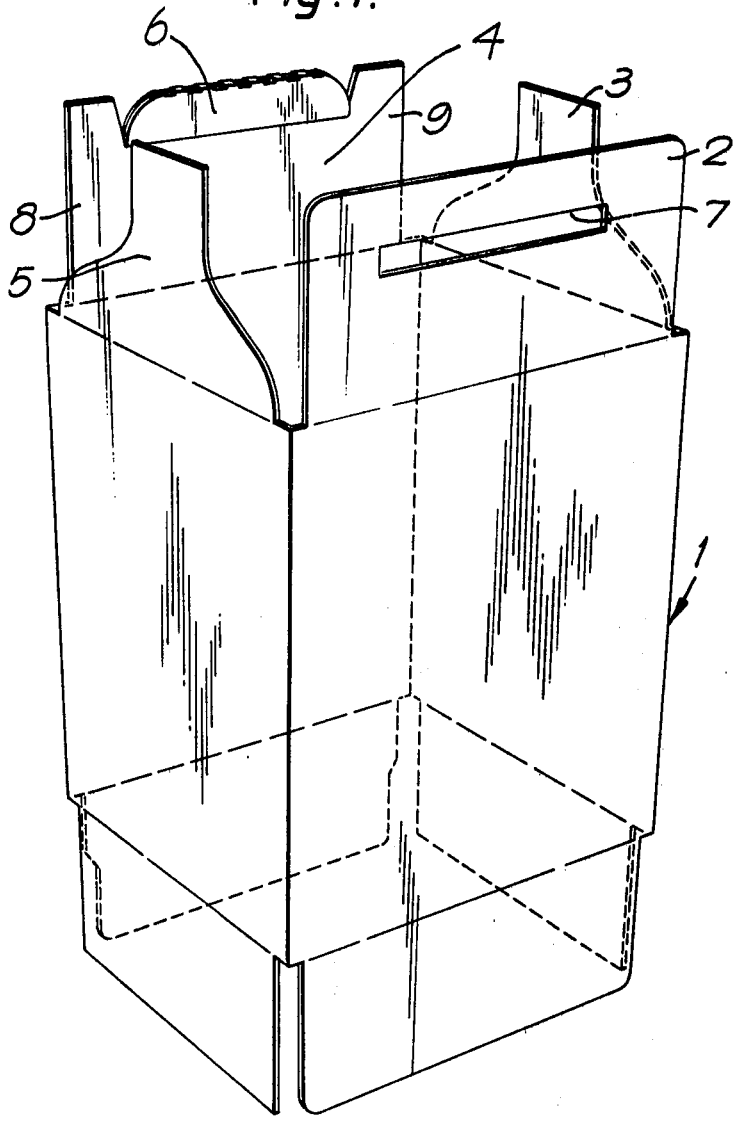
FIG. 1 is a perspective view of a partially erected carton constructed in accordance with the invention.
Figure 10:
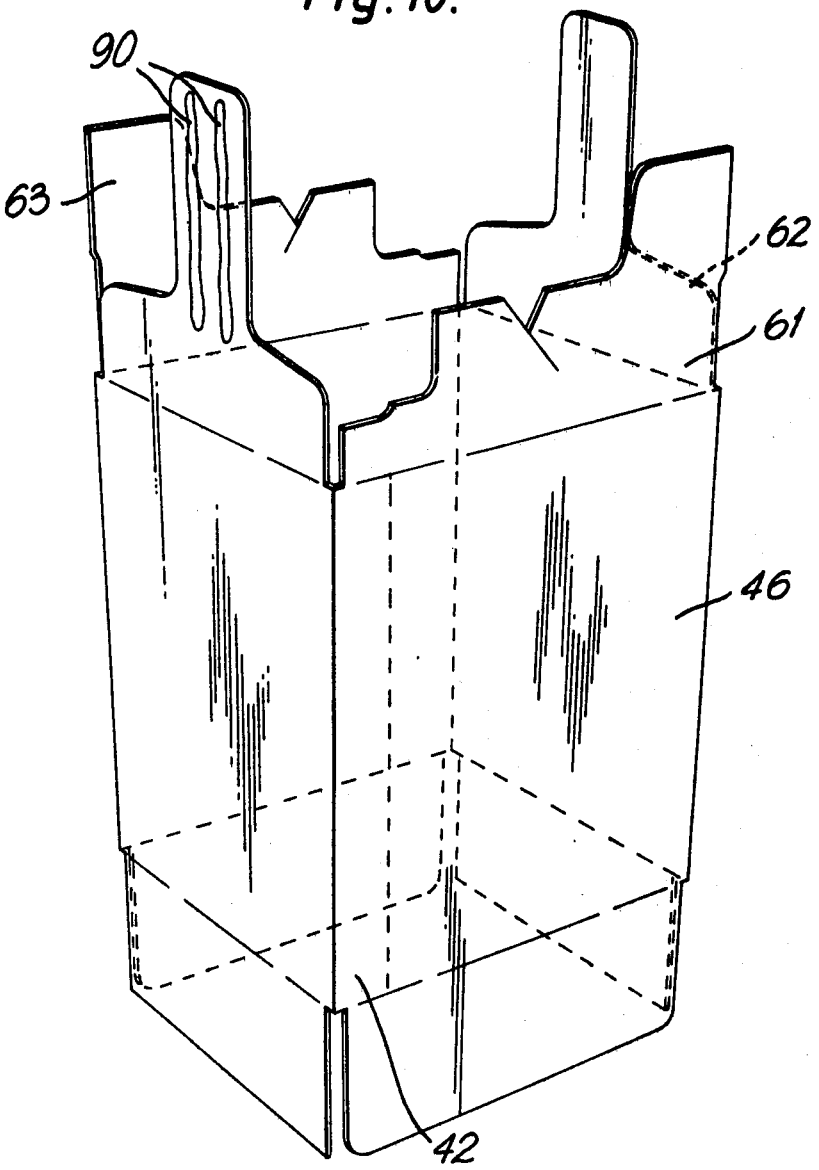
Figure 11:
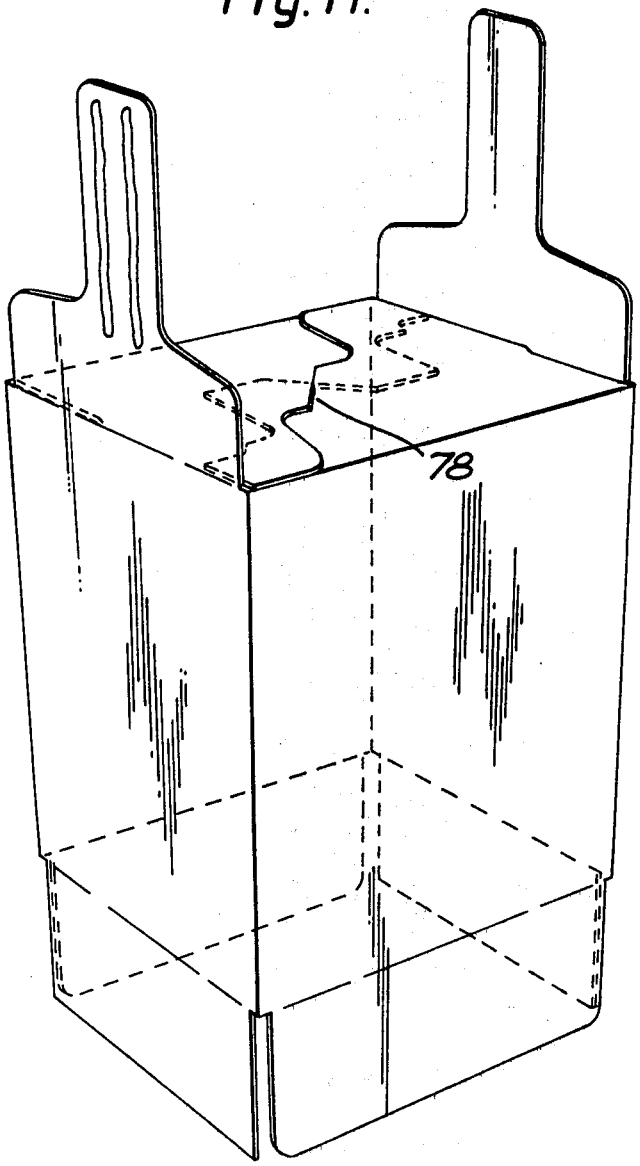

FIGS. 10 and 11 show elevational isometric views of a carton having a blank of FIG. 9 and initial steps taken to close one end of the carton blank construction of FIG. 1.

Figure 2:
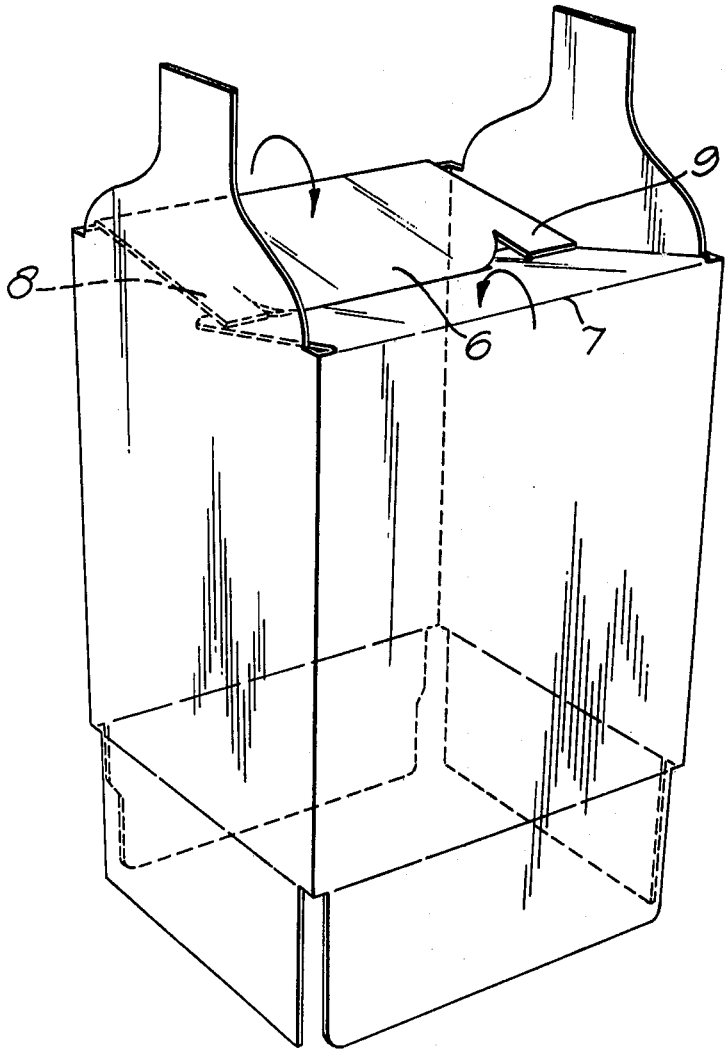
FIGS. 2 and 3 illustrate the steps taken for folding the flaps of the upper end of the carton of FIG. 1 to form a closed end with a carry handle.
Figure 3:
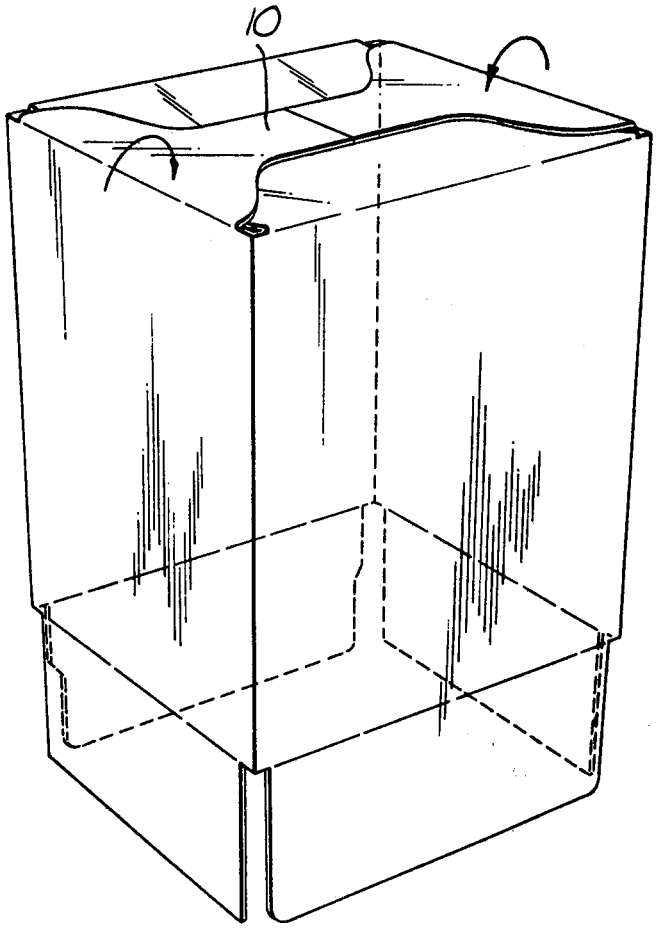
Figure 3A:
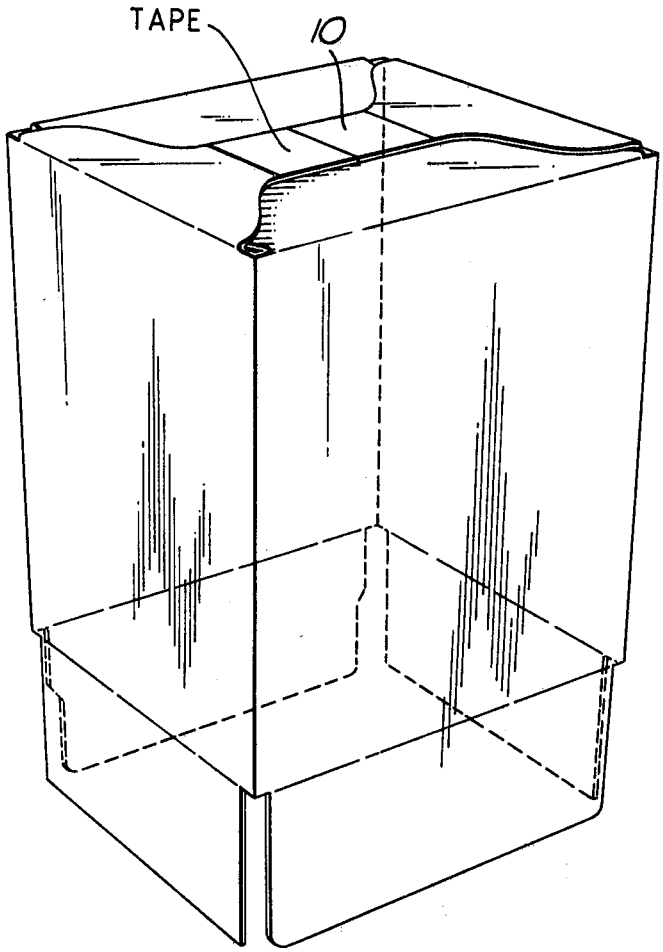
Figure 3B:
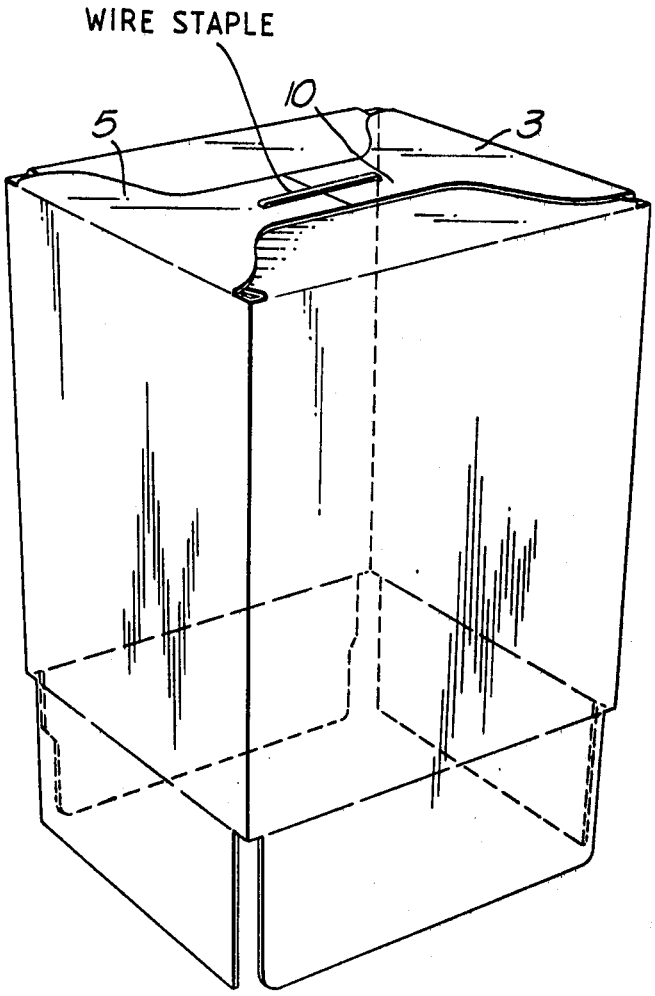
Figure 3C:
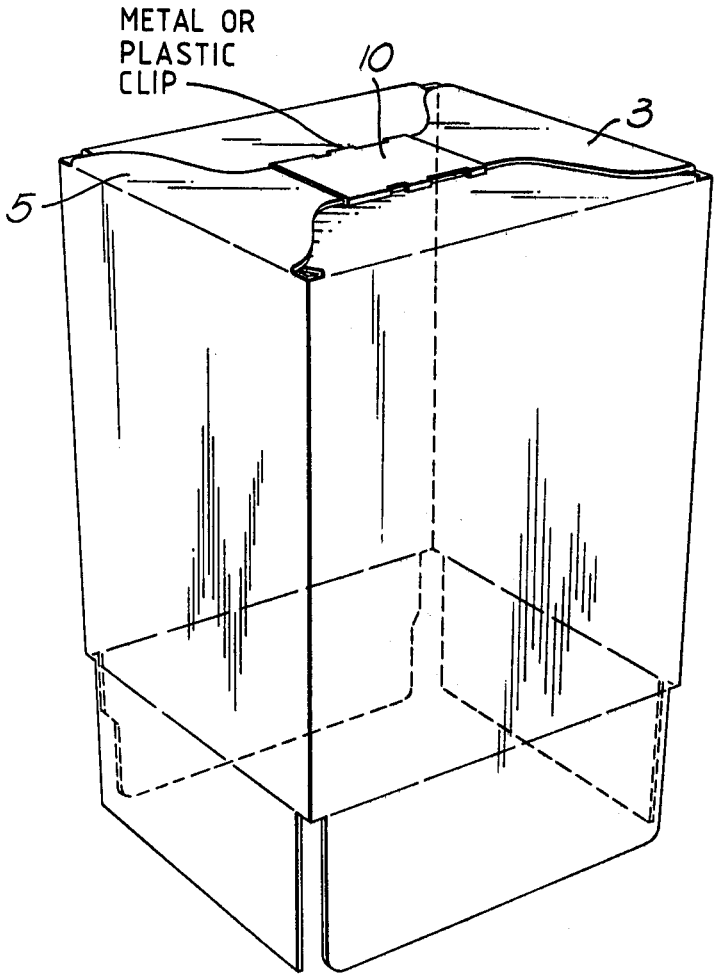

Referring to FIGS. 1, 2, 3, *3a*, *3b* and *3c*, the carton blank generally designated 1 may be constructed from any suitable sheet material such as solid fibreboard, corrugated board, E flute board or plastic etc. The sheet may be creased and cut using conventional processes and folded to form the tubular configuration of FIG. 1 with a square or rectangular cross-section, the various flaps protruding therefrom. The ends of the folded blank are overlapped and are held together by any appropriate means such as gluing or stapling. As the bottom flaps of the carton are of conventional construction, these will not be discussed further.

The upper flaps 2, 3, 4 and 5 all form an integral part of the blank from which the carton is constructed. Means for holding the two flaps 2 and 4 together when they are folded down over the carton end may be provided in the form of the tongue and slot 6 and 7 respectively. When these two flaps are folded in the manner illustrated in FIG. 2, the tongue 6 fits into the slot 7 and the extensions 8 and 9 forming part of the flap 4 rest on the upper surface of flap 2. The same effect can be achieved by providing an adhesive on the upper surface of an equivalent unslotted flap 2 and folding the opposite flap thereover to close off the carton end.

Opposed flaps 3 and 5 are then folded down over the flaps 2 and 4 which already close off the carton, and are joined together by any appropriate means such as adhesive taping, stapling or using a clip as shown in FIGS. *3a*, *3b* and *3c* respectively. The opposed flaps 3 and 5 are constructed in such a way that a relatively narrow elongate grip portion 10 is formed in the region of the centre of the carton end when the two are joined together. In the illustrated embodiment the ends of the flaps 3 and 5 abut each other when they are folded down. However, it is also possible to form flaps which overlap to achieve the same result.

The ends of the flaps 3 and 5 joining onto the tubular portions of the carton are preferably as close to the width of the carton end as is practicable to ensure maximum strength of attachment of the hand grip portion to the carton.

In the alternative embodiment shown in FIGS. 4 to 8 inclusive, a carton blank 30 has been formed into a hollow tubular member with integral upper flap members 31, 32, 33 and 34. Flap member 32 is made longer than its opposed flap member 31 so that when it is folded down over the carton end (FIG. 5) adhesive means such as the line of hot melt adhesive are applied thereto, the opposed flap 31 is folded thereover, and the two flaps are adhered together to close off the carton end.

Flap 31 is formed with a line of perforations 35 or the equivalent which permit the elongate strip 36 to be separated therefrom. When the flap 31 has been adhered to flap 32 the exposed surface of the strip which has been formed so that it is aligned with the narrow portions of the flaps 33 and 34 when they are folded down, is treated with a line of contact adhesive 37. Thus, when the flaps 33 and 34 are folded down, the strip 36 becomes adhered thereto and joins them together. The strip readily separates from the flap 31 because of the perforations 35 to form the slightly raised hand grip portion 38. After the hand grip end of the carton has been formed and sealed off, the carton is held bottom up and product is introduced through the open bottom end. Thereafter the bottom end flaps are sealed off using conventional methods to form the completed package with integral lay flat carry handle.

The first opposed pair of flaps may also include interengaging means which are adapted to hold said first pair of flaps together when they are folded down over the end of the carton.

Referring to FIG. 9, there are shown two complete carton blanks, 40 and 40A, and fragmentary portions of two other blanks 41 and 42A, adjacent hereto. All these carton blanks are cut out on a flat sheet of board material, such as E-flute corrugated board, and the solid lines shown in the drawings represent lines which are cut through the board, whereas the broken lines represent fold or crease lines. The carton blank 40 comprises five main sections numbered 42, 43, 44, 45 and 46 respectively, which may be folded to form a tubular carton blank of square or rectangular cross-section with the end flap 42 acting to hold the carton in its tubular form when it is glued to the section 46. A conventional arrangement of bottom flaps numbered 50, 51, 52 and 53, is provided at the base of the blank to enable the bottom end of the carton to be closed off. As this is a conventional arrangement no further discussion of the bottom end of the carton is necessary for the purposes of this specification.

A series of integral flaps numbered 60, 61, 62 and 63 are attached at the top section of the carbon blank 40, and these are shaped in such a way that they correspond to the sections 60A, 61A, 62A and 63A, of the blank 40A, with relatively little wastage of board material therebetween. Thus, the elongate portion 70 of flap 60 fits into the corresponding cut out portion 71A of flap 63A. Similarly, the extended portions 72 and 72A of the flaps 61 and 63A respectively are arranged to follow each others contours to make maximum use of board space. Thus, intermediate portions 75A and 75 are cut out to an extent sufficient to allow the extended portions 72 and 72A to interfit.

The flaps 61 and 63A may also be provided with interengaging means for purposes to become apparent. These means may comprise the V-shaped notches 78 and 78A, which are alternately associated with a protrusion 79 or 79A, and a slit 80 or 80A.

Carton blanks manufactured from a board according to FIG. 9 may be erected in a series of steps two of which are shown in FIGS. 10 and 11 to form a carton with a closed off top having an integral carry handle and an open bottom which may receive the contents to be packaged.

FIG. 10 illustrates the blank 40 of FIG. 9 which has been folded along the crease lines to form an open ended tubular container and the flap 42 has been glued or attached to the side 46 to hold the container in this configuration. One or more of the flap members may be provided with means for joining two flaps to form a handle member. In the illustrated embodiment, the joining means comprise one or more lines of adhesive 90 which have been sprayed onto the upper surface of the handle portion 70 of flap 60.

In FIG. 11 the flap members 62 and 63 have been jointly folded together so that interengaging means provided on each flap in the form of V shaped notches 78, slits 80, protrusions 79 and extended portions 72 interact to form a friction fit between the flaps when they are folded flat to close the carton end.

I claim:

1. A carton blank for forming a carton of square or rectangular cross-section therefrom, wherein said carton blank is adapted to be folded and joined to form a carton which is provided at one end with two pairs of opposed integral flaps, the first of said pairs of flaps being adapted to overlap and close off said carton end when folded thereover, the second of said opposed pairs of flaps each reducing in width from its connection with the carton end to form narrow extended portions, whereby said narrow extended portions may be joined when said second opposed pair of flaps is folded flat over the carton end to form a composite handle member which lies generally flat over the carton end, covering and generally following the direction of a line joining the sides of the carton end to which said second opposed pair of flaps are attached and bisecting said carton end, said composite handle member having a carry handle portion opposite ends of which join the broader sections of said second opposed pair of flaps, said carry handle portion having a width substantially less than the edges of the carton end to which said second opposed pair of flaps are attached, one flap of said first pair of opposed integral flaps including an integral strip with means for facilitating severing of said strip therefrom, said one flap being dimensioned so that said strip underlies said carry handle portion when said first and second pairs of opposed flaps are folded down over said carton end.

2. A carton blank according to claim 1 wherein said severing means comprises score lines, slits, performations or combinations thereof.

3. A multi-carton blank having at least two carton blanks each being a blank according to claim 1, said multi-carton blank formed from a single sheet of material and having a joinder area extending longitudinally of said sheet and in which said first and second pairs of flaps of each said blank are located, said flaps of one said blank being staggered relative to said flaps of the other said blank so that portions of said flaps of said one blank are contiguous with portions of said flaps of said other blank, and wherein the extended portions of said second pairs of flaps of said one blank are received in cut out portions in respective ones of said first pair of flaps in said other blank, said first pairs of flaps of each said blank being generally triangular and with the longer edge of the triangle forming the distal edge of said first flaps, said first flaps having a further cut out portion and a nose portion whereby said nose portions of said first flaps of said one blank are received in a respective said further cut out portion of said first flaps of said other blank.

4. A multi-carton blank according to claim 3 wherein said longer edge of each said first flap is provided with interengaging means to enable said first flaps of said one blank to interengage to close off the end of a formed carton.

5. A multi-carton blank according to claim 4 wherein said interengaging means comprises a V-shaped notch and a slit extending from said notch into said first flap.

6. A carton formed from a carton blank for forming a carton of square or rectangular cross-section therefrom whrein said carton blank is adapted to be folded and joined to form a carton which is provided at one end with two pairs of opposed integral flaps, the first of said pairs of flaps being adapted to overlap and close off said carton end when folded thereover, the second of said opposed pairs of flaps each reducing in width from its connection with the carton end to form narrow extended portions, whereby said narrow extended portions may be joined when said second opposed pair of flaps is folded flat over the carton end to form a composite handle member which lies generally flat over the carton end, covering and generally following the direction of a line joining the sides of the carton end to which said second opposed pair of flaps are attached and bisecting said carton end, said composite handle member having a carry handle portion opposite ends of which join the broader sections of said second opposed pair of flaps, said carry handle portion having a width substantially less than the edges of the carton end to which said second opposed pair of flaps are attached, one flap of said first pair of opposed integral flaps including an integral strip with means for facilitating severing of said strip therefrom, said one flap being dimensioned so that said strip underlies said carry handle portion when said first and second pairs of opposed flaps are folded down over said carton end.

* * * * *